United States Patent [19]

Thorsteinsson et al.

[11] 3,988,708

[45] Oct. 26, 1976

[54] CONTROLLED DROOP THERMOSTAT

[75] Inventors: John B. Thorsteinsson; Herbert T. Hazleton, both of Brandon, Canada

[73] Assignee: Federal Pioneer Electric Limited, Toronto, Canada

[22] Filed: July 11, 1975

[21] Appl. No.: 595,225

[30] Foreign Application Priority Data

Dec. 3, 1974 Canada ..... 213,922

[52] U.S. Cl. ..... 337/379; 337/111

[51] Int. Cl.[2] ..... H01H 37/52

[58] Field of Search ..... 337/100, 101, 111, 377, 337/378, 379; 236/91; 165/14, 27, 28

[56] References Cited

UNITED STATES PATENTS

| | | | |
|---|---|---|---|
| 3,023,287 | 2/1962 | Epstein | 337/111 X |
| 3,196,233 | 7/1965 | Burch et al. | 337/111 X |
| 3,234,346 | 2/1966 | Taylor et al. | 337/111 |
| 3,238,779 | 3/1966 | Wolfe | 337/379 |
| 3,463,008 | 8/1969 | Teichert et al. | 337/378 X |
| 3,466,587 | 9/1969 | Rechoq et al. | 337/379 X |
| 3,573,701 | 4/1971 | Graham et al. | 337/378 |

*Primary Examiner*—J D Miller
*Assistant Examiner*—Fred E. Bell

[57] ABSTRACT

Limited droop thermostats in which a bimetal tongue extends from an end of the main ambient temperature-sensing bimetal. The tongue responds to heat emitted by the thermostat switch and acts to compensate for the incidental exposure of the main bimetal to switch heat. In the preferred embodiment the projecting end of the compensating tongue is mechanically fixed and one end of the main bimetal is unitary with and carried by the base of the compensating tongue. Certain features of the invention are present in another embodiment in which the main bimetal element has a conventional supporting pivot at one end and the set-point adjusting end of the main bimetal carries the compensating tongue whose projecting end is movable and actuates the thermostat switch.

12 Claims, 12 Drawing Figures

FIG. 1
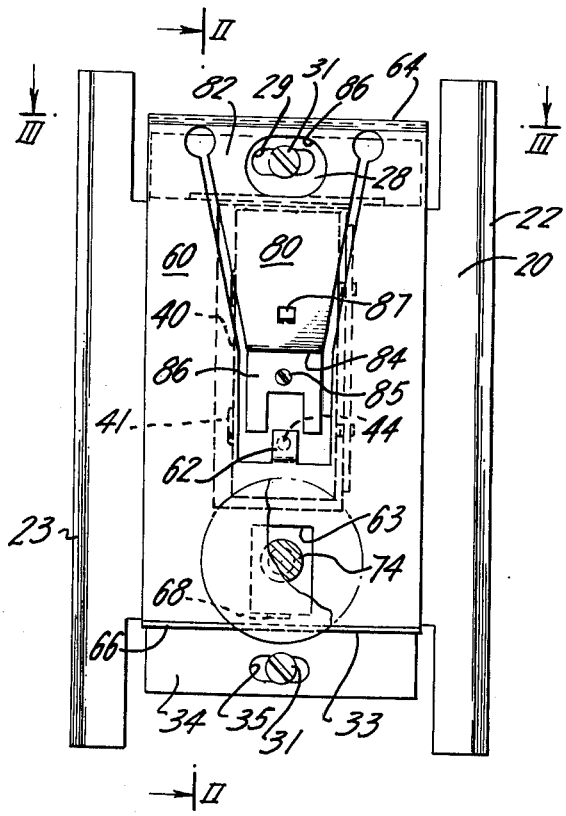
FIG. 2
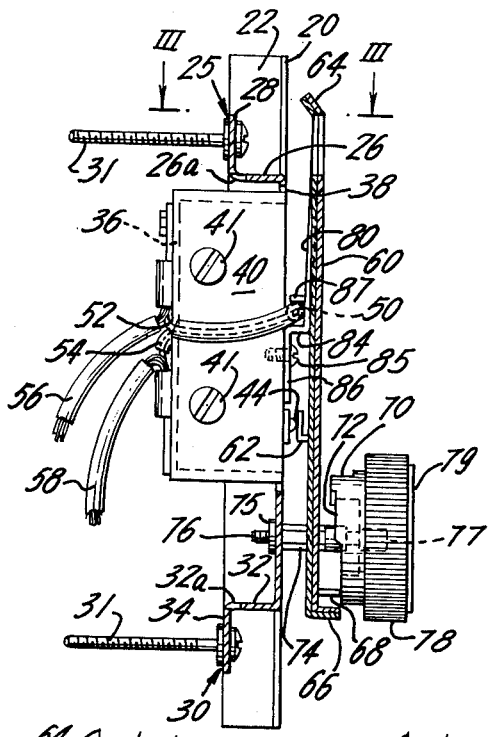
FIG. 3
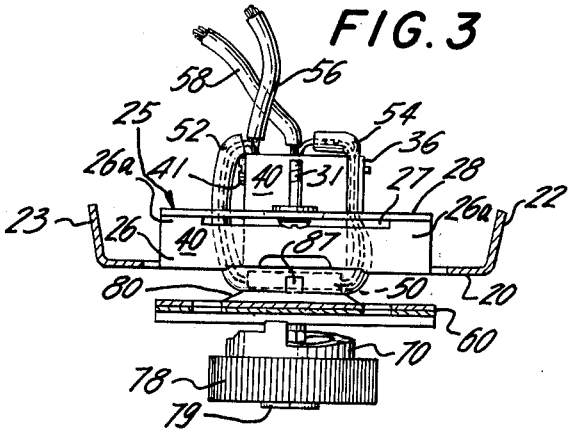
FIG. 5
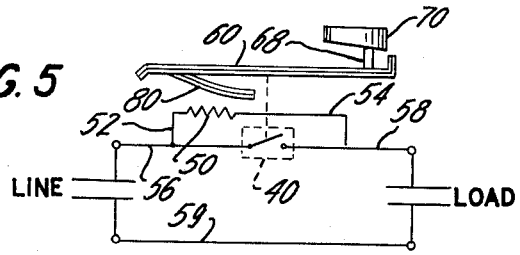
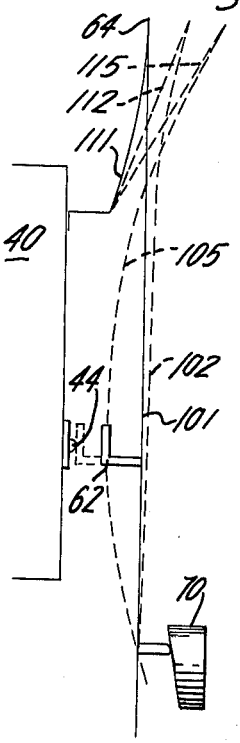
FIG. 4
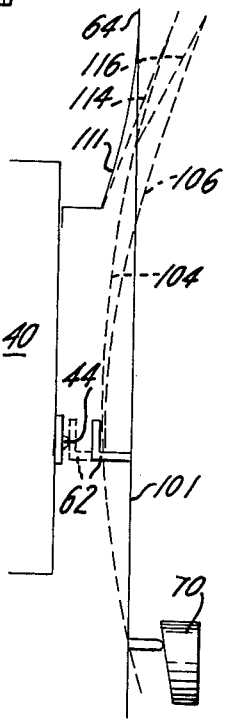
FIG. 4A FIG.6
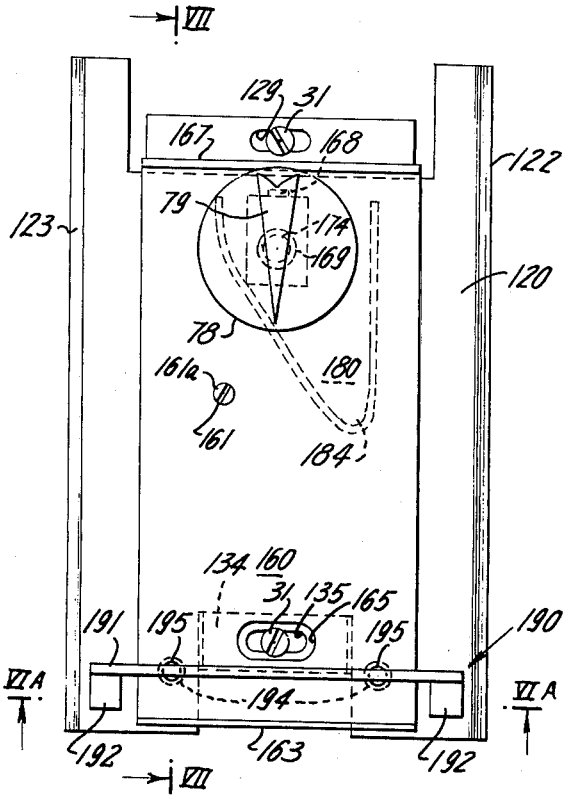
FIG.7
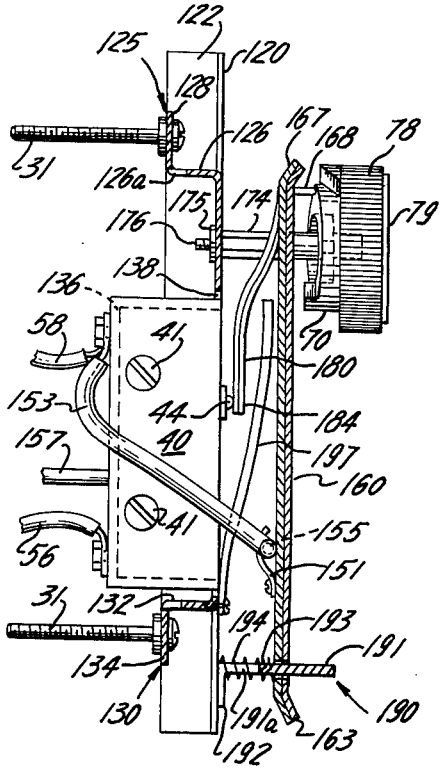
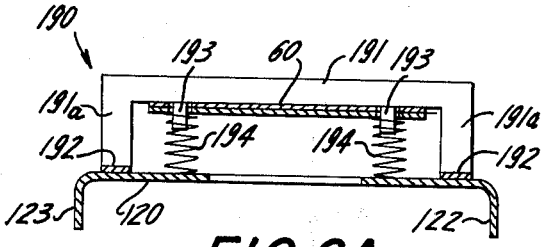
FIG.6A
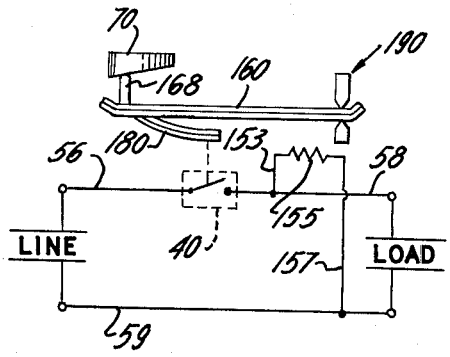
FIG.9
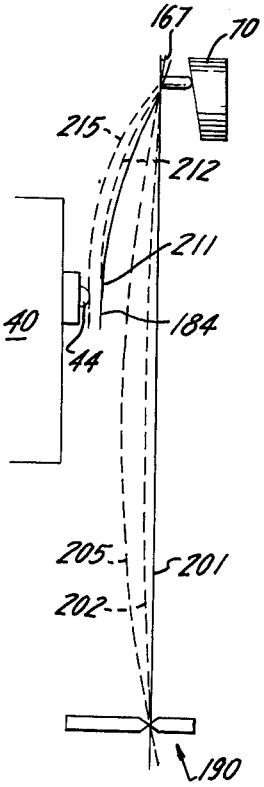
FIG.8
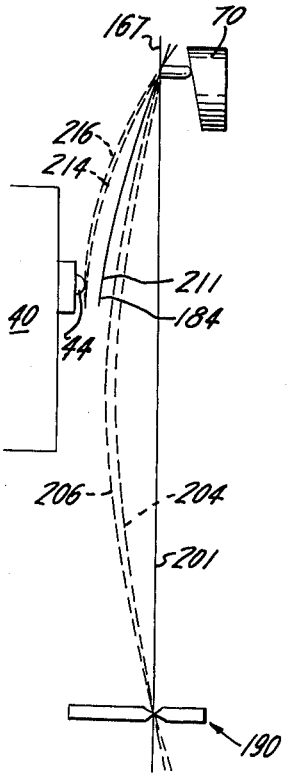
FIG.8A

CONTROLLED DROOP THERMOSTAT

BACKGROUND OF THE INVENTION

This invention relates to thermostats for electric heating or cooling apparatus. More particularly, the invention is concerned with so-called line voltage thermostats, wherein the load current required by an electric heater or a room air conditioner is carried by the switch that forms part of the thermostat.

The switching means that forms part of line voltage thermostats is proportioned to carry and to switch relatively heavy load current. The line current supplied to a room electric heater (for example) is switched on and off by switching means that forms part of a line voltage thermostat. This contrasts with the low levels of current carried by the switch in a thermostat designed for controlling a relay (so-called "low-voltage" thermostats) wherein it is the relay that carries and switches the load current. In low-voltage thermostats, the switch in the thermostat does not become heated as a result of the small current that it carries, so that internal self-heating is not a problem in low-voltage thermostats.

The conduction of relatively heavy current by the switch of a line-voltage thermostat produces a significant amount of heat. This heat tends to modify the temperature in the ambient temperature sensing zone of the thermostat. The effect is small in mild weather, when the switch is closed for only short periods, with relatively long intervening periods when the switch is open. On the other hand, when an electric room heater (or air conditioner) is called upon to operate for long periods with only short interruptions, then a substantial amount of heat is produced by the current conducted by the thermostat switch. The temperature in the ambient-temperature measuring zone is raised significantly by this heat. The temperature sensing element "sees" a higher temperature than actually prevails in the room and, accordingly, tends to control the temperature modifying apparatus of the room so as to establish a lower temperature in the room than that for which the thermostat is set. This effect is called "droop". Droop has been a persistent, troublesome characteristic of line-voltage thermostats.

One approach to providing a line-voltage thermostat having a controlled droop characteristic or characterized by a minimum or even a zero droop is disclosed and claimed in U.S. Pat. No. 3,553,624 for an Anti-Droop Thermostat. In that patent, a supplementary heater is incorporated in a line-voltage thermostat to develop heat during the time intervals when the switch is off and when the load current that develops heat in the switch is consequently interrupted. To perform in the intended manner, the resistor in that thermostat should be selected to produce an amount of heat that matches the heat produced in the switch by the load current. Other line-voltage thermostat arrangements have been developed or proposed that are relatively complicated and expensive, involving the use of compensating elements arranged to act between the main bimetal of the thermostat and the thermostat switch or within the switch itself, for meeting the problem of thermostat droop.

Thermal cycle-timing resistors that are incorporated in thermostats have the effect of inducing the thermostat to cycle on-and-off five or more times per hour. When cycle-timing heating elements are not used, the thermostat responds slowly to the effects of the room heater with the result that the room temperature tends to overshoot excessively above and below the temperature setting of the thermostat. Known thermostats incorporating thermal cycle-timing involve various problems and complications in connection with the location and the mounting of the heating resistor.

SUMMARY OF THE INVENTION

Line voltage thermostats should be adapted for the control of a wide range of loads. The same thermostat type may, within the same house or other building, be used to control electric heat loads varying from a nominal 250 watts up to a rating of approximately 5,000 watts or higher. Any load rating within this range is possible and, therefore, it is an object of this invention to provide an uncomplicated thermostat operable over a wide range of controlled loads that is less affected by localized heating of the thermostat switch.

Wall thermostats are usually mounted on a wall of a room remote from the outside walls of a building. Consequently, during a period of cold weather, the thermostat does not sense a temperature corresponding to that which develops in the room near the outside walls, and the personal comfort of the occupants therefore suffers. Some people consider it desirable to adjust a thermostat to a higher setting during periods of extreme cold weather in order to have a more comfortable room, i.e. to compensate somewhat for the cold-wall effect.

A further object of the invention resides in providing line-voltage thermostats with what may be called a "negative droop" or "rise" characteristic for controlling room heating, for automatically raising the set-point to compensate for the cold-wall effect during very cold weather.

The illustrated embodiments provide low droop thermostats in which a compensating bimetal extends from an end of the ambient temperature-sensing bimetal. The compensator responds to heat emitted by the thermostat switch during conduction and acts to oppose the effect of switch heat on the main bimetal. In the preferred embodiment the projecting end of a compensating tongue is mechanically fixed and one end of the main bimetal is integral with and carried by the base of the compensating tongue. In another illustrative embodiment, the main bimetal element is supported by a conventional pivot at one end and the set-point adjusting end of the main bimetal carries a compensating tongue whose projecting end is movable and actuates the thermostat switch. In both forms of thermostat the compensating tongue is prominently exposed to the radiation of heat from the switch and to convection currents of air heated by the switch (or switches) in contrast to the limited exposure of the main or ambient temperature sensing bimetal to the heat developed in the switch. In a more detailed aspect of the invention, the compensating bimetal element is physically formed as part of the same bimetal sheet that forms the main bimetal element.

In the preferred embodiment, the fixed end of the compensating bimetal element is directly secured to the thermostat switch, and is heated by conduction providing prominent thermal coupling between the compensating bimetal element and the switch, whereas there is notably less thermal coupling or exposure of the main bimetal to the heat of the switch.

In the preferred embodiment, the droop-compensating bimetal has a heater mounted adjacent its fixed end so as to serve as part of a thermally actuated cycle timer. In that arrangement, the compensator does not impede movement of the bimetal elements in responding to temperature changes, and it is relatively simple and easy to mount the heater in assembling the thermostat, without concern that the heater might impede response of the bimetal elements to temperature changes. These thermostats having low "droop" or "rise" characteristics can have a remarkably shallow profile as measured from the front to the wall mounting surface.

DESCRIPTION OF THE DRAWINGS

FIG. 1 is a front view of a thermostat embodying features of the invention, with the cover removed and the adjusting knob represented by dotted lines;

FIGS. 2 and 3 are side and top sectional views of the thermostat of FIG. 1, viewed from planes II—II and III—III therein;

FIGS. 4 and 4A are schematic illustrations of the deflection of the bimetal elements of the thermostat of FIGS. 1 – 3 under different conditions;

FIG. 5 is a wiring diagram showing the use of the thermostat of FIGS. 1 – 3 and diagrammatically illustrating that thermostat;

FIG. 6 is a front view of another thermostat illustrating certain features of the invention;

FIG. 6A is a cross section of the thermostat in FIG. 6 as viewed the section - line VIA — VIA;

FIG. 7 is a cross-sectional view of the thermostat of FIG. 6 viewed from the plane VII—VII in FIG. 6;

FIGS. 8 and 8A are schematic illustrations of the deflection of the bimetal elements of the thermostat of FIGS. 6 and 7 under different conditions;

FIG. 9 is a wiring diagram showing the use of the thermostat of FIGS. 6 and 7 and diagrammatically illustrating that thermostat.

DESCRIPTION OF THE PREFERRED EMBODIMENTS

In the drawings of FIGS. 1 – 3, the preferred embodiment of the novel thermostat includes a base plate 20 that is formed economically of sheet metal. Alternatively, the base plate can be formed as a casting or as a molded plastic part. Base plate 20 has integral side walls 22 and 23 formed at an angle therefrom and a support member 25 which includes a wall 26 perpendicular to the front of the base plate and which supports a strip 28 which is parallel to the front. An elongated slot 27 is formed between strip 28 and wall 26 of the support member leaving narrow support legs **26*a* at the ends of strip 28, perpendicular to the plane of strip 28. A smaller elongated slot 29 is provided in strip 28 for receiving a screw 31 or other fastener. Likewise, a bottom support member 30 for the base plate includes a perpendicular wall 32 and a parallel support strip 34 having an elongated slot 33 at their junction, leaving narrow support legs 30*a* at the ends of strip 34, perpendicular to the plane of strip 34. A shorter elongated slot 35 is provided in strip 34 for receiving a screw 31. Strips 28 and 34 provide a supporting structure for the switch-mounting plate 20** that has distinctive advantages, and is the subject of a companion patent application.

Base plate 20 also has a vertical support plate 36 perpendicular to the front and adjacent a rectangular opening 38 in the base plate for receiving a switch 40 having an enclosure attached to plate 36 by bolts 41.

Switch 40 has an actuating plunger 44 extending from the front thereof and is of the snap-switch type requiring only limited travel of the plunger for causing snap-switch actuation of the switching mechanism between "open" and "closed", and between "closed" and "open" positions.

A small heating resistor 50 is disposed across the front of switch housing 40 and is connected across the switch terminals by conductors 52 and 54 which connect with line conductors 56 and 58, respectively, for a power input terminal and a load terminal of the device.

A main bimetal element 60 is disposed parallel to base plate 20 and has an integral foot 62 offset from the rear surface thereof for engaging plunger 44 to actuate the snap-switch 40. Main bimetal 60 is the ambient temperature sensing element and is formed of an elongated sheet of bimetal having ends 64 and 66 and an integral upwardly turned post 68 near end 66 for engaging the surface of a cam 70 for adjustment of the set-point of the thermostat. The switch actuator 44 provides spring bias urging the bimetal to the right in FIG. 2, and biases post 68 against cam 70. Cam 70 includes a ridge 72 for positive actuation of the switch to hold the switch open regardless of the ambient temperature. Cam 70 is supported from base plate 20 by an internally threaded bushing 74. The end of bushing 74 is reduced in diameter, passed through base plate 20 and spun over at the rear to provide a fastening means 75 to restrain axial movement thereof and to frictionally lock it against rotation. Fastening means 75 also secures bushing 74 against tilting motion. A knob 78 having a pointer 79 is connected to the front of cam 70, for rotating the cam. The knob and cam are carried by a threaded shaft 76 extending through the bushing, providing for rotation of the cam and the knob.

A compensating tongue 80 of bimetal is cut from bimetal sheet 60 or formed integral therewith and has its high expansion metal facing in the same direction as main bimetal 60. The end 64 of ambient temperature sensing bimetal 60 is unitary with and carried by base 82 of compensating tongue 80 as a cantilever. The projecting end 84 of the compensating tongue extends toward the opposite end of bimetal 60, is fixed to switch 40 by screw 85 and contacts auxiliary heating resistor 50 for the maximum deflection of the tongue by both switch heat and by the resistor heat. A tab 86 is cut from compensating tongue 80 and bent down against resistor 50 to improve the heat coupling of the compensating tongue to resistor 50 and for mechanical retention of the resistor. The close proximity of the compensating tongue 80 to switch 40 and the exposure of a large portion of its area to the switch and its attachment thereto closely heat-couples the compensating tongue to the switch. This thermal coupling is much closer than the incidental exposure of a small part of the distant ambient sensing bimetal 60 to switch heat. Since the high expansion sides of the compensating bimetal tongue 80 and the ambient sensing bimetal 60 face in the same direction, they bow or warp in the same direction, but act differentially on the switch since they are joined in mechanical series at the base of the tongue. The compensating tongue is also exposed to the ambient atmosphere and main bimetal 60 should, therefore, be substantially longer than the compensator to provide adequate response to ambient temperature changes.

Heat generated in switch 40 by current conduction tends to increase the bow or deflection of main bimetal 60 and thereby causes switch plunger 44 to be depressed and open the switch at an ambient temperature below the set-point. Bimetal tongue 80 raises or lowers the cantilevered end 64 of main bimetal 60 inwardly or outwardly responsive to the amount of heat generated in switch 40 to compensate for the effect of switch heat on the main bimetal. Compensating tongue 80 raises cantilevered end 64 of main bimetal 60 as the switch conducts for longer periods on a cold day and generates more heat within itself, which ensures that the ambient temperature in the room is maintained at the set-point.

The thermostat of FIGS. 1–3 is constructed to be mounted in an upright position with base 82 of bimetal tongue 80 at the top so that most of the bimetal tongue is located above the body of switch 40. In this orientation, convection currents of air entering at the bottom and heated by switch 40 will rise along the surfaces of bimetal tongue 80 for the best heat-coupling between the switch and the compensating bimetal tongue. A cover (not shown) having ventillating openings in the top and bottom engages the base plate for protectively enclosing the thermostat against the wall and allowing the convection of air through it from the room.

The operation of the thermostat of FIGS. 1 – 3 can be understood with reference to the drawing of FIGS. 4 and 4A. It is assumed that under the initial conditions of the ambient temperature in the room to be controlled and of the set-point position of the cam 70, that the ambient sensing bimetal 60 will be substantially flat as indicated by line 101 and that the compensating bimetal tongue 80 assumes the configuration of curve 111 in FIGS. 4 and 4A. Under these conditions the foot 62 of main bimetal 60 will not depress actuator 44 of the switch 40 so that the switch will remain closed and conduct current to the associated electrical room heater or other apparatus to be controlled.

The conduction of current by switch 40 will generate some heat therein which is transmitted by radiation and convection to compensating bimetal 80, and to a lesser extent to main bimetal 60. As shown in FIG. 4, this switch heat will cause the compensating tongue to deflect to curve 112 without change in the ambient room temperature, which will raise the cantilevered end 64 of the main bimetal element, which will itself assume curvature 102. In this position the foot 62 of the main bimetal remains essentially stationary and does not depress the plunger 44 and the switch 40 remains closed. As the ambient temperature in the room or air space to be controlled rises toward the set-point of cam 70, both the compensating tongue 80 and the main bimetal 60 will increase their curvature until the compensating bimetal assumes curvature 115 and the ambient sensing bimetal assumes curvature 105. Curvature 105 of the ambient sensing bimetal 60 will cause its foot 62 to depress actuator 44 to cause the switch 40 to open and interrupt current to the heater. Thus, the effect of switch heat alone on the bimetal elements will not cause the current control switch to open. Instead, the ambient temperature in the room must rise to the set-point so that the ambient sensing bimetal assumes curve 105 to open the switch as desired.

The response of the bimetal elements of the thermostat of FIGS. 1–3 to different amounts of heat generated in switch 40 is shown in FIG. 4A. The ambient sensing bimetal 60 is initially substantially flat as indicated by line 101 and the compensating bimetal 80 initially assumes the curve 111. In this condition foot 62 of the main bimetal does not depress plunger 44 of the switch so that the switch remains closed and conducts current to the electric heater. As the ambient temperature in the room increases responsive to the electric heater, compensating bimetal tongue 80 will assume curvature 114 which raises the cantilevered end 64 of the main bimetal 60 which will assume curvature 104. In this condition, the effect of switch heat upon the main bimetal element is compensated for by the increased curvature of the compensating tongue 80 and the net deflections of the compensating bimetal and of the ambient sensing bimetal 80 will cause the foot 62 of the main bimetal to depress plunger 44 to open the switch and interrupt the current to the heater. The setting of cam 70 enables a curvature 104 of the main bimetal 60 to actuate the switch in this example.

If the temperature outside or adjacent the room should become extemely cold, then switch 40 would have to conduct current to the electric heating elements for a longer period of time during each heating cycle in order to maintain the ambient temperature in the room at the set-point. This increased duty cycle in the switch results in a greater amount of heat being generated therein which will cause the compensating bimetal 80 to deflect to curve 116 and further raise cantilevered end 64 of the main bimetal, which will assume curvature 106. As is shown in the drawing, the increased curvature 116 of the compensating bimetal compensates for the increased curvature 106 of the ambient sensing bimetal so that plunger 44 of switch 40 will not be depressed before the ambient temperature in the room reaches the set-point.

Compensating bimetal tongue 80 is heated by resistor 50 to cause the thermostat to be cycled ON and OFF more frequently, thus reducing the ambient temperature range in the room to be controlled. As shown in FIG. 5, the line terminals are connected to conductors 56 and 59 and the load is connected to conductors 58 and 59. Heating resistor 50 is connected across the terminals of normally-closed switch 40 by conductors 52 and 54 and conducts only when the switch is open. The resistance value of resistor 50 is quite large so that the current through it to the load which by-passes the opened switch 40 has no detectable heating effect in the load but generates sufficient heat in resistor 50 to shorten the duration of the closed and open cycles of the switch. This heating of compensating tongue 80 allows plunger 44 to release and close switch 40 upon less drop in the ambient temperature which reduces the ambient temperature range of the thermostat. This heating of the compensating tongue is desirable because the deflection of practical bimetal sheets is limited and a certain amount of lost motion is usually incurred in snap switch 40 before it closes or opens.

In the thermostat of the embodiment illustrated in FIGS. 6 and 7 some components are similar to or identical with those of the thermostat embodiment of FIGS. 1–3. These common parts are identified by the same numbers. A base plate 120 having side walls 122 and 123 is provided with slots 129 and 135 for receiving screws 31 for attaching the thermostat to an electrical outlet box or to the heater structure itself. A vertical support plate 136 perpendicular to the front of base plate 120 is provided adjacent a rectangular opening 138 in the base plate for receiving a snap switch 40 which is attached to support plate 136 by bolts 41. An actuating plunger 44 is provided on the switch.

Ambient temperature sensing bimetal 160 is spaced from base plate 120 by a pivot 190 having legs 191*a*, feet 192 and tabs 193 engaging openings 195 in the bimetal and springs 194 between it and the base plate. The set-point adjusting end 167 of the main bimetal carries a post 168 for engaging cam 70 and has an opening 169 for receiving the shaft 174 which supports the cam 70 from the base plate 120. Adjustment knob 78 is attached to cam 70. An opening 165 is provided in main bimetal 160 for permitting access to screw 31.

A compensating tongue 180 of bimetal is cut from bimetal sheet 160 or otherwise formed integrally therewith at the adjustment end 167 of the main bimetal. The free end 184 of the compensating bimetal tongue 180 is aligned with plunger 44 of snap switch 40 for actuating it. A switch actuating calibration screw 183 may also be provided on the ambient sensing bimetal 160 for actuating a second pole of a two-pole switch (not shown) if that is desired. A fibre sheet 197 is placed between switch 40 and bimetal 160 to reduce the exposure of the main bimetal to switch heat.

Since the higher expansion metal of the main bimetal 160 and of the compensating bimetal tongue 180 face in the same direction, their direction of curvature responsive to ambient temperature and to switch heat is in the same direction also. Under the initial conditions of a selected setting of cam 70 and of an ambient temperature in the room to be controlled, the ambient sensing bimetal 160 will be substantially flat as represented by line 201 and the bimetal tongue 180 will assume curvature 211 as in FIGS. 8 and 8A. Current will be conducted to the electric heater by normally closed switch 40 in this condition.

The conduction of current by switch 40 will cause heat to be generated in the switch which is transmitted to compensating tongue 180 by radiation and convection and, to a lesser extent, to ambient sensing bimetal 160. This switch heat wil cause the ambient sensing bimetal 160 to assume curvature 202 which will cause the compensating tongue 180 to deflect toward the switch, but the increased curvature 212 of the bimetal tongue 180 away from the switch will compensate for the effect of switch heat on the ambient sensing bimetal so that the plunger 44 of the switch will not be depressed by the end 184 of the bimetal tongue.

When the ambient temperature in the room increases to the set-point established by cam 70 responsive to the electric heater, the ambient sensing bimetal assumes curvature 205 which deflects the compensating bimetal 180 toward the switch. The compensating bimetal assumes curvature 215 away from the switch, however, so that plunger 44 is not depressed until the set-point temperature is reached.

The response of the bimetal elements to different amounts of switch heat is illustrated in FIG. 8A. The ambient sensing bimetal 160 is initially substantially flat as indicated by line 201 and the compensating bimetal tongue 180 initially assumes curvature 211. In this initial condition, plunger 44 of the switch is not depressed and the normally closed switch 40 conducts current to the electric heater. As the ambient temperature in the room rises to the set-point established by cam 70, the ambient sensing bimetal assumes curvature 204 which deflects the bimetal tongue 180 toward the switch. The bimetal tongue assumes curvature 216 away from the switch reponsive to both the increased ambient temperature and to the switch heat which cancels out the effect of switch heat. Plunger 44 of the switch will thus not be depressed until the ambient temperature in the room reaches the set-point.

On an extremely cold day, switch 40 will conduct for a longer period during each heating cycle in order to maintain the ambient temperature in the room to be controlled in the range of the set-point. This increased conduction time in switch 40 generates greater heat therein which causes ambient sensing bimetal 160 to assume curvature 206 which will further deflect bimetal tongue 180 toward the switch. The bimetal tongue, however, will assume curvature 216 away from the switch responsive to both the ambient temperature in the room and the increased switch heat, which compensates for the effect of switch heat on the two bimetal elements. The actuating end 184 of the compensating bimetal tongue 180 will therefore not depress plunger 44 of the switch until the ambient temperature in the room reaches the set-point established by cam 70.

A heating resistor 155 is disposed against the rear surface of the ambient sensing bimetal 160 and held in place by a retainer 151. The resistor 155 is connected to the load terminal 58 of the snap switch 40 by conductor 153 and has another conductor 157 for connection to the other side of the load. A conductor 56 is connected to the line terminal of the switch 40.

As shown in FIG. 9, the line terminals are connected to conductors 56 and 59 and the load terminals are connected to conductors 58 and 59. The snap switch 40 is connected to conductors 56 and 58 and the resistor 155 is connected across the load by conductors 153 and 157. Cycle-timing resistor 155 is of a high resistance value and provides a low amount of heat to the ambient sensing bimetal 160 when the switch is closed to energize the load. This shortens the duration of the closed and open cycles of the switch by providing a small amount of heat to the main bimetal 160 when the switch is closed. The effect of cycle-timing resistor 155 is to reduce the range of temperature fluctuation in the air space to be controlled.

What we claim is:

1. A thermostat for controlling the current in a load in response to ambient temperature, including a switch, cam means for adjusting the set-point of the thermostat and ambient temperature sensing means for controlling the switch, said ambient temperature sensing means comprising an elongated ambient temperature sensing bimetal element, a compensating bimetal element having a portion that is integral with a portion of the ambient temperature sensing bimetal element with the high expansion surfaces of the integrated portions of the bimetal elements facing in the same direction, said bimetal elements being disposed to act differentially on the switch in response to changes in temperature, and said compensating bimetal element being more closely heat-coupled to the switch than any incidental heat coupling of the ambient temperature sensing bimetal element with the switch.

2. A thermostat as in claim 1, wherein the compensating bimetal element is elongated and integral at one end with the ambient temperature sensing bimetal element, in mechanical series therewith.

3. A thermostat as in claim 1, wherein the compensating bimetal element is incidentally exposed to ambient temperature in addition to its heat-coupling to the switch, and the ambient temperature sensing bimetal element is substantially longer than said compensating bimetal element.

4. A thermostat as in claim 2, wherein said compensating bimetal element comprises a bimetal tongue having its base extending as a unitary part of an end of the ambient temperature sensing bimetal element and wherein the projecting end of the bimetal tongue is mechanically fixed.

5. A thermostat as in claim 4, wherein the switch has an insulating enclosure and wherein the fixed end of the bimetal tongue is fixed to the enclosure of the switch.

6. A thermostat as in claim 4, wherein said bimetal tongue extending from said end of the ambient temperature sensing bimetal element extends toward the opposite end of the ambient temperature sensing bimetal element.

7. A thermostat as in claim 4, wherein said cam means acts upon the ambient temperature sensing bimetal element proximate the other end thereof, further comprising a foot carried by the ambient temperature sensing bimetal element intermediate the ends thereof for actuating the switch.

8. A thermostat as in claim 1, further comprising thermal cycling resistance means spaced from the ambient temperature sensing element, closely heat-coupled to the compensating bimetal element, and electrically connected across said switch.

9. A thermostat as in claim 8, wherein the projecting end of the compensating element is mechanically fixed and said resistance means is mounted adjacent the fixed end of the compensating element.

10. A thermostat as in claim 1, wherein said cam means acts upon the ambient temperature sensing bimetal element proximate one end thereof and the compensating bimetal element comprises a bimetal tongue extending from said one end of the ambient temperature sensing bimetal element and the projecting end of the bimetal tongue is movable for actuating the switch.

11. A thermostat as in claim 9, wherein said bimetal tongue extending from said one end of the ambient temperature sensing bimetal element extends toward the opposite end of the ambient sensing element.

12. A thermostat as in claim 1, wherein said ambient temperature sensing bimetal element and the compensating bimetal element are unitary with each other, being formed from a single sheet of bimetal.

* * * * *